US007548852B2

(12) United States Patent
Den Brinker et al.

(10) Patent No.: US 7,548,852 B2
(45) Date of Patent: Jun. 16, 2009

(54) QUALITY OF DECODED AUDIO BY ADDING NOISE

(75) Inventors: Albertus Cornelis Den Brinker, Eindhoven (NL); François Philippus Myburg, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 357 days.

(21) Appl. No.: 10/562,359

(22) PCT Filed: Jun. 25, 2004

(86) PCT No.: PCT/IB2004/051010

§ 371 (c)(1),
(2), (4) Date: Dec. 27, 2005

(87) PCT Pub. No.: WO2005/201814

PCT Pub. Date: Jan. 6, 2005

(65) Prior Publication Data

US 2007/0124136 A1 May 31, 2007

(30) Foreign Application Priority Data

Jun. 30, 2003 (EP) ..... 03101938

(51) Int. Cl.
*G10L 19/00* (2006.01)

(52) U.S. Cl. ..... 704/219; 704/220; 704/226; 704/500

(58) Field of Classification Search ..... 704/219, 704/220, 226, 500
See application file for complete search history.

(56) References Cited

U.S. PATENT DOCUMENTS

| | | | | |
|---|---|---|---|---|
| 7,197,454 | B2 * | 3/2007 | Van Der Kerkhof et al. | 704/219 |
| 7,313,519 | B2 * | 12/2007 | Crockett | 704/226 |
| 7,321,559 | B2 * | 1/2008 | Etter et al. | 370/242 |
| 2002/0154774 | A1 * | 10/2002 | Oomen et al. | 380/236 |
| 2002/0156619 | A1 * | 10/2002 | Van De Kerkhof et al. | 704/203 |

* cited by examiner

*Primary Examiner*—Daniel D Abebe

(57) ABSTRACT

The present invention relates to a method of encoding and decoding an audio signal. The invention further relates to an arrangement for encoding and decoding an audio signal. The invention further relates to a computer-readable medium comprising a data record indicative of an audio signal and a device for communicating an audio signal having been encoded according to the present invention. By the method of encoding, a double description of the signal is obtained, where the encoding comprises two encoding steps, a first standard encoding and an additional second encoding. The second encoding is able to give a coarse description of the signal, such that a stochastic realization can be made and appropriate parts can be added to the decoded signal from the first decoding. The required description of the second encoder in order to make the realization of a stochastic signal possible requires a relatively low bit rate, while other double/multiple descriptions require a much higher bit rate.

12 Claims, 5 Drawing Sheets

QUALITY OF DECODED AUDIO BY ADDING NOISE

Figure 1:
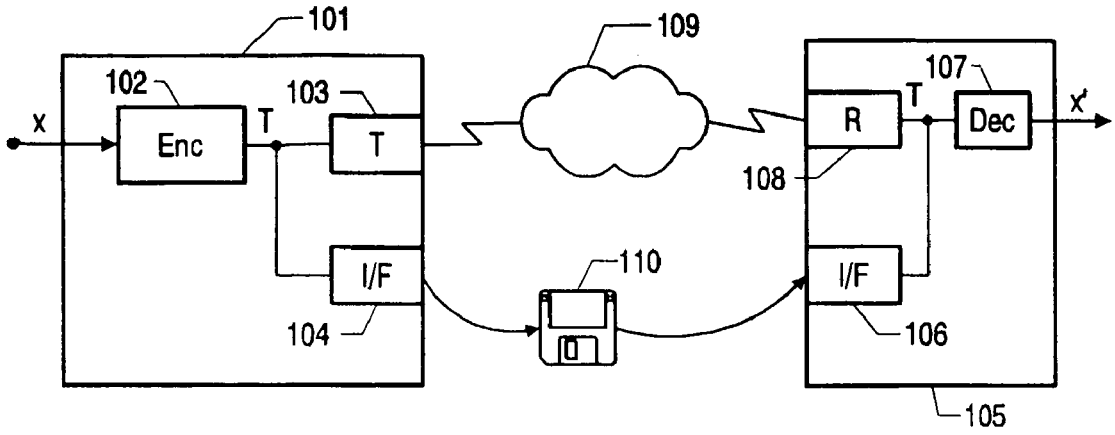

The present invention relates to a method of encoding and decoding an audio signal. The invention further relates to a device for encoding and decoding an audio signal. The invention further relates to a computer-readable medium comprising a data record indicative of an encoded audio signal and to an encoded audio signal.

One way of coding is by letting parts of audio or speech signals be modeled by synthetic noise, while maintaining a good or acceptable quality and e.g. bandwidth extension tools are based on this notion. In bandwidth extension tools for speech and audio, the higher frequency bands are typically removed in the encoder in case of low bit rates and recovered by either a parametric description of the temporal and spectral envelopes of the missing bands or the missing band is in some way generated from the received audio signal. In either case, knowledge of the missing band(s) (at least the location) is necessary for generating the complementary noise signal.

This principle is performed by creating a first bit stream by a first encoder given a target bit rate. The bit rate requirement induces some bandwidth limitation in the first encoder. This bandwidth limitation is used as knowledge in a second encoder. An additional (bandwidth extension) bit stream is then created by the second encoder, which covers the description of the signal in terms of noise characteristics of the missing band. In a first decoder, the first bit stream is used to reconstruct the band-limited audio signal, and an additional noise signal is generated by the second decoder and added to the band-limited audio signal, whereby the full decoded signal is obtained.

A problem of the above is that it is not always known to the sender or to the receiver, which information is discarded in the branch covered by the first encoder and the first decoder. For instance, if the first encoder produces a layered bit stream and layers are removed during the transmission over a network, then neither the sender or the first encoder nor the receiver or the first decoder have knowledge of this event. The removed information may for instance be sub-band information from the higher bands of a sub-band coder. Another possibility occurs in sinusoidal coding: in scalable sinusoidal coders, layered bit streams can be created, and sinusoidal data can be sorted in layers according to their perceptual relevance. Removing layers during transmission without additionally editing the remaining layers to indicate what has been removed typically produces spectral gaps in the decoded sinusoidal signal.

The basic problem in this set-up is that neither the first encoder nor the first decoder have information on what adaptation has been made on the branch from the first encoder to the first decoder. The encoder misses the know-ledge, because the adaptation may take place during transmission (i.e. after encoding), while the decoder simply receives an allowed bit stream.

Bit-rate scalability, also called embedded coding, is the ability of the audio coder to produce a scalable bit-stream. A scalable bit-stream contains a number of layers (or planes), which can be removed, lowering the bit-rate and the quality as a result. The first (and most important) layer is usually called the "base layer," while the remaining layers are called "refinement layers" and typically have a pre-defined order of importance. The decoder should be able to decode pre-defined parts (the layers) of the scalable bit-stream.

In bit-rate scalable parametric audio coding it is general practice to add the audio objects (sinusoids, transients and noise) in order of perceptual importance to the bit-stream.

Individual sinusoids in a particular frame are ordered according to their perceptual relevance, where the most relevant sinusoids are placed in the base layer. The remaining sinusoids are distributed among the refinement layers, according to their perceptual relevance. Complete tracks can be categorized according to their perceptual relevance and distributed over the layers, with the most relevant tracks going to the base layer. To achieve this perceptual ordering of individual sinusoids and complete tracks, psycho-acoustic models are used.

It is known to place the most important noise-component parameters in the base layer, while the remaining noise parameters are distributed among the refinement layers. This has been described in the document with the title Error Protection and Concealment for HILN MPEG-4 Parametric Audio Coding. H. Purnhagen, B. Edler, and N. Meine. Audio Engineering Society (AES) $110^{th}$ Convention, Preprint 5300, Amsterdam (NL), May 12-15, 2001.

The noise component as a whole could also be added to the second refinement layer. Transients are considered the least-important signal component. Hence, they are typically placed in one of the higher refinement layers. This is described in the document with the title A 6 kbps to 85 kbps Scalable Audio Coder. T. S. Verma and T. H. Y. Meng. 2000 IEEE International Conference on Acoustics, Speech, and Signal Processing (ICASSP2000). pp. 877-880. Jun. 5-9, 2000.

The problem with a layered bit-stream constructed in the manner as described above is the resulting audio quality of each layer: Dropping sinusoids by removing refinement layers from the bit-stream results in spectral "holes" in the decoded signal. These holes are not filled by the noise component (or any other signal component), since the noise is usually derived in the encoder given the complete sinusoidal component. Furthermore, without the (complete) noise component, additional artifacts are introduced. These methods of producing a scalable bit-stream result in an un-graceful and un-natural degradation in audio quality.

It is an object of the present invention to provide a solution to the above-mentioned problems.

This is obtained by a method of encoding an audio signal, wherein a code signal is generated from the audio signal according to a predefined coding method, and wherein the method further comprises the steps of:

transforming the audio signal into a set of transformation parameters defining at least a part of the spectro-temporal information in said audio signal, said transformation parameters enabling generation of a noise signal having spectro-temporal characteristics substantially similar to said audio signal, and representing said audio signal by said code signal and said transformation parameters.

Thereby a double description of the signal is obtained comprising two encoding steps, a first standard encoding and an additional second encoding. The second encoding is able to give a coarse description of the signal, such that a stochastic realization can be made and appropriate parts can be added to the decoded signal from the first decoding. The required description of the second encoder in order to make the realization of a stochastic signal possible requires little bit rate, while other double/multiple descriptions would require much more bit rate. The transformation parameters could e.g. be filter coefficients describing the spectral envelope of the audio signal and coefficients describing the temporal energy or amplitude envelope. The parameters could alternatively be additional information consisting of psycho-acoustic data such as the masking curve, the excitation patterns or the specific loudness of the audio signal.

In an embodiment the transformation parameters comprise prediction coefficients generated by performing linear prediction on the audio signal. This is a simple way of obtaining the transformation parameters, and only a low bit rate is needed for transmission of these parameters. Furthermore, these parameters make it possible to construct simple decoding filtering mechanisms.

In a specific embodiment the code signal comprises amplitude and frequency parameters defining at least one sinusoidal component of said audio signal. Thereby the problems with parametric coders as described above can be solved.

In a specific embodiment the transformation parameters are representative of an estimate of an amplitude of sinusoidal components of said audio signal. Thereby the bit rate of the total coding data is lowered, and further an alternative to time-differential encoding of amplitude parameters is obtained.

In a specific embodiment the encoding is performed on overlapping segments of the audio signal, whereby a specific set of parameters is generated for each segment, the parameters comprising segment specific transformation parameters and segment specific code signal. Thereby the encoding can be used for encoding large amounts of audio data, e.g. a live stream of audio data.

The invention also relates to a method of decoding an audio signal from transformation parameters and a code signal generated according to a predefined coding method, the method comprising the steps of:

decoding said code signal into a first audio signal using a decoding method corresponding to said predefined coding method, generating from said transformation parameters a noise signal having spectro-temporal characteristics substantially similar to said audio signal generating a second audio signal by removing from the noise signal spectro-temporal parts of the audio signal that are already contained in the first audio signal, and generating the audio signal by adding the first audio signal and the second audio signal.

Thereby the method can sort out which spectro-temporal parts of the first signal generated by the decoding method are missing and fill these parts up with appropriate (i.e. in accordance with the input signal) noise. This result in an audio signal, which is spectro-temporally closer to the original audio signal.

In an embodiment of the method of decoding said step of generating the second audio signal comprises:

deriving a frequency response by comparing a spectrum of the first audio signal with a spectrum of the noise signal, and filtering the noise signal in accordance with said frequency response.

In a specific embodiment of the method of decoding said step of generating the second audio signal comprises:

generating a first residual signal by spectrally flattening the first audio signal in dependence on spectral data in the transformation parameters, generating a second residual signal by temporally shaping a noise sequence in dependence on temporal data in the transformation parameters, deriving a frequency response by comparing a spectrum of the first residual signal with a spectrum of the second residual signal, and filtering the noise signal in accordance with said frequency response.

In another embodiment of the method of decoding said step of generating the second audio signal comprises:

generating a first residual signal by spectrally flattening the first audio signal in dependence on spectral data in the transformation parameters, generating a second residual signal by temporally shaping a noise sequence in dependence on temporal data in the transformation parameters, adding the first residual signal and the second residual signal into a sum signal, deriving a frequency response for spectrally flattening the sum signal, updating the second residual signal by filtering the second residual signal in accordance with said frequency response, repeating said steps of adding, deriving and updating until a spectrum of the sum signal is substantially flat, and filtering the noise signal in accordance with all of the derived frequency responses.

The invention further relates to a device for encoding an audio signal, the device comprising a first encoder for generating a code signal according to a predefined coding method, wherein the device further comprises:

a second encoder for transforming the audio signal into a set of transformation parameters defining at least a part of the spectro-temporal information in said audio signal, said transformation parameters enabling generation of a noise signal having spectro-temporal characteristics substantially similar to said audio signal, and processing means for representing said audio signal by said code signal and said transformation parameters.

The invention also relates to a device for decoding an audio signal from transformation parameters and a code signal generated according to a predefined coding method, the device comprising:

a first decoder for decoding said code signal into a first audio signal using a decoding method corresponding to said predefined coding method, a second decoder for generating from said transformation parameters a noise signal having spectro-temporal characteristics substantially similar to said audio signal, first processing means for generating a second audio signal by removing from the noise signal spectro-temporal parts of the audio signal that are already contained in the first audio signal, and adding means for generating the audio signal by adding the first audio signal and the second audio signal.

The invention further relates to an encoded audio signal comprising a code signal and a set of transformation parameters, wherein said code signal is generated from an audio signal according to a predefined coding method and wherein the transformation parameters define at least a part of the spectro-temporal information in said audio signal, wherein said transformation parameters enable generation of a noise signal having spectro-temporal characteristics substantially similar to said audio signal.

The invention also relates to a computer-readable medium comprising a data record indicative of an encoded audio signal encoded by a method of encoding according to the above.

Figure 2:
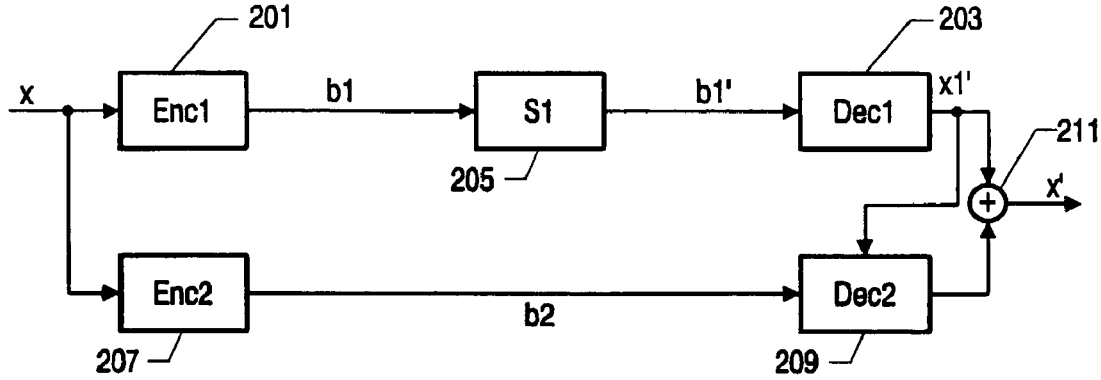
Figure 3:
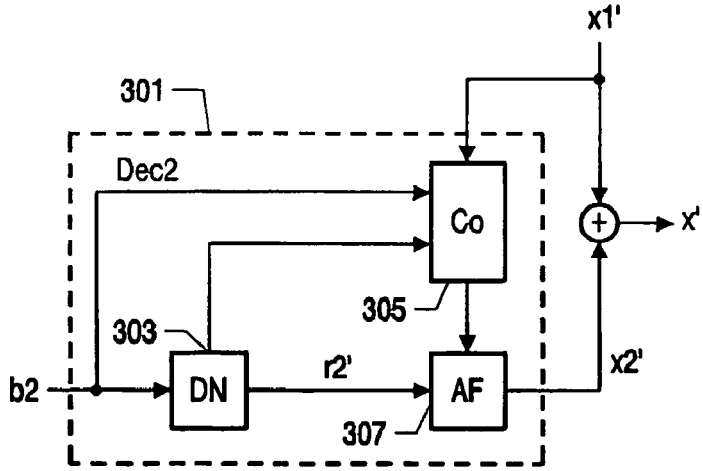
Figure 4:
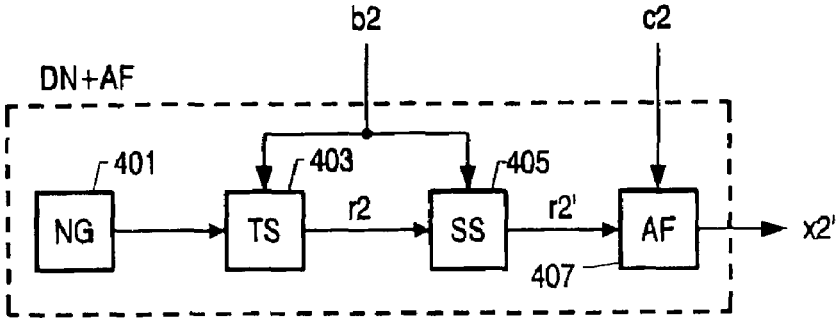
Figure 5:
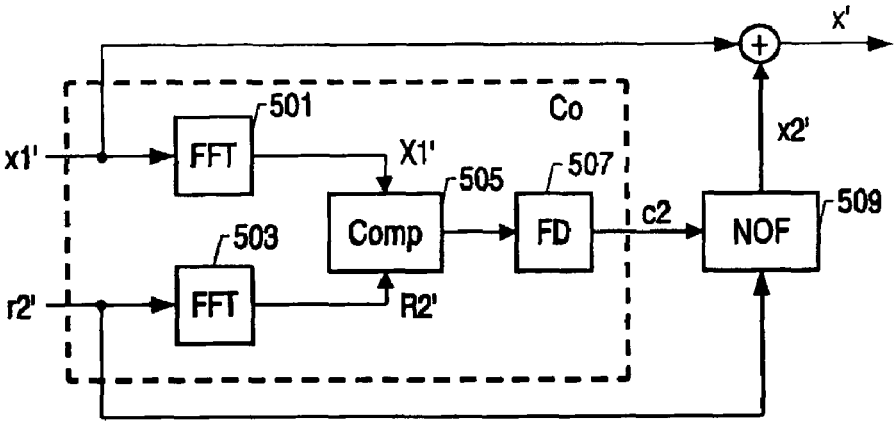
Figure 6:
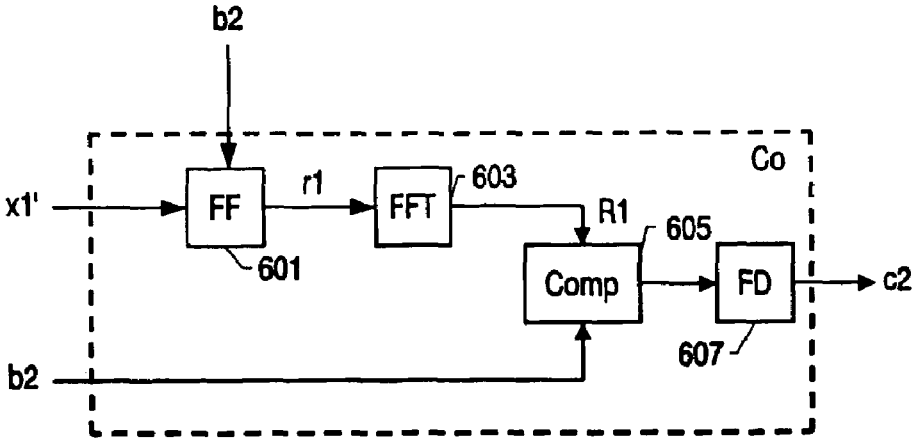
Figure 7:
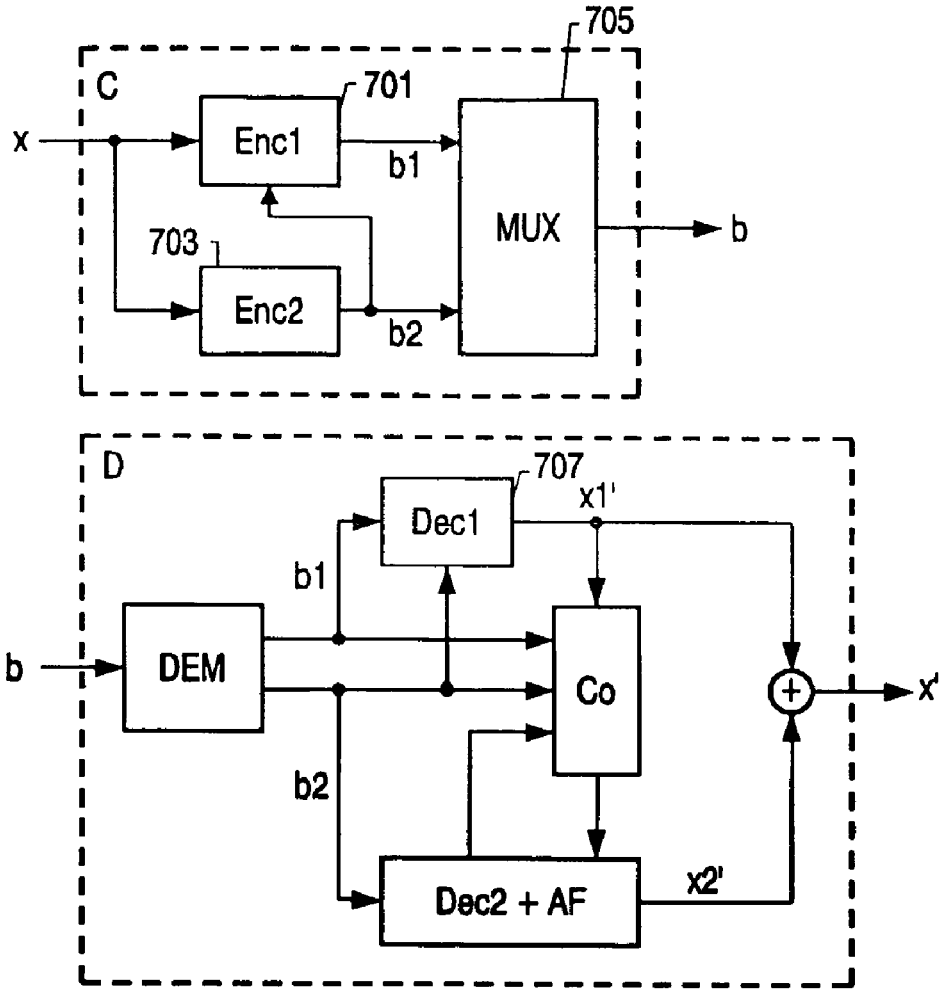
Figure 8:
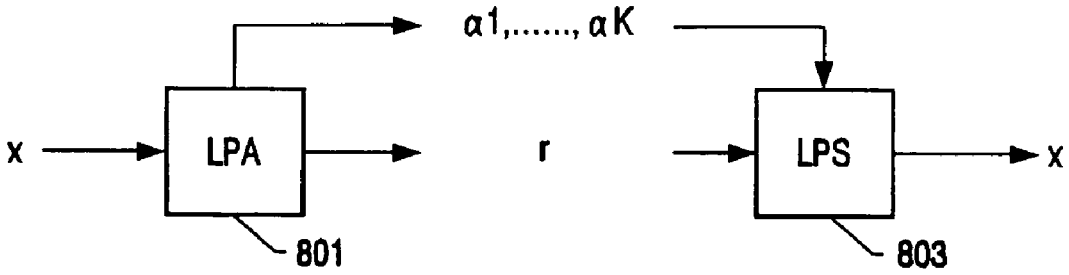
Figure 9:
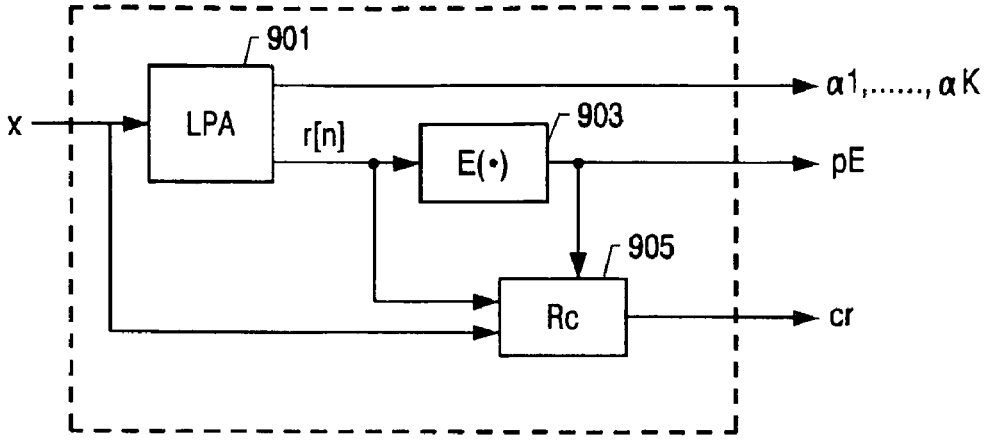
Figure 10:
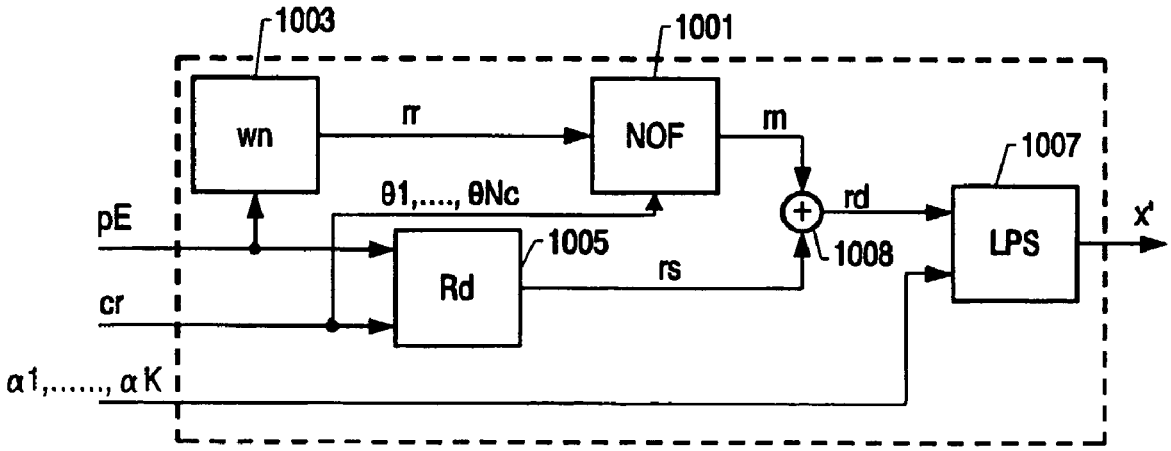
Figure 11:
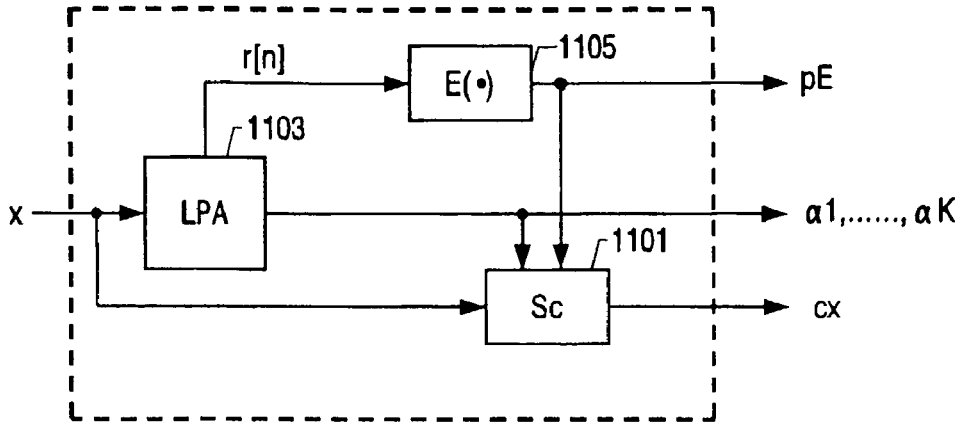
Figure 12:
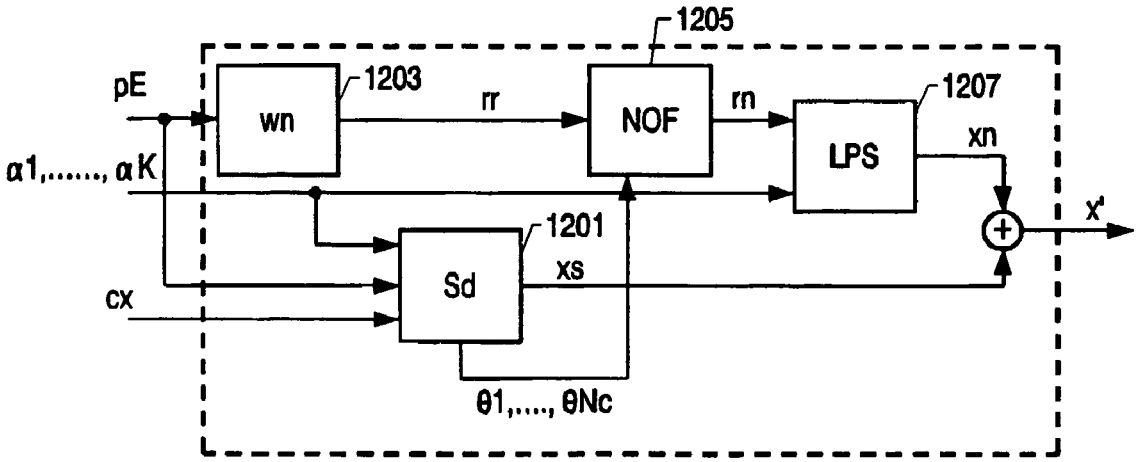

In the following preferred embodiments of the invention will be described referring to the Figures, where FIG. 1 shows a schematic view of a system for communicating audio signals according to an embodiment of the invention, FIG. 2 illustrates the principle of the present invention, FIG. 3 illustrates the principle of a decoder according to the present invention, FIG. 4 illustrates a noise signal generator according to the present invention, FIG. 5 illustrates a first embodiment of a control box to be used in the noise generator, FIG. 6 illustrates a second embodiment of a control box to be used in the noise generator, FIG. 7 illustrates an example where the present invention is used to improve performance in specific coders, where the first encoder and the first decoder use the parameters created by the second embodiment of the encoder, FIG. 8 illustrates linear prediction analysis and synthesis, FIG. 9 illustrates a first advantageous embodiment of an encoder according to the present invention, FIG. 10 illustrates an embodiment of a decoder for decoding a signal coded by the encoder of FIG. 9, FIG. 11 illustrates a second advantageous embodiment of an encoder according to the present invention, FIG. 12 illustrates an embodiment of a decoder for decoding a signal coded by the encoder of FIG. 11.

FIG. 1 shows a schematic view of a system for communicating audio signals according to an embodiment of the invention. The system comprises a coding device 101 for generating a coded audio signal and a decoding device 105 for decoding a received coded signal into an audio signal. The coding device 101 and the decoding device 105 each may be any electronic equipment or part of such equipment. Here the term electronic equipment comprises computers, such as stationary and portable PCs, stationary and portable radio communication equipment and other handheld or portable devices, such as mobile telephones, pagers, audio players, multimedia players, communicators, i.e. electronic organizers, smart phones, personal digital assistants (PDAs), handheld computers or the like. It is noted that the coding device 101 and the decoding device may be combined in one piece of electronic equipment, where stereophonic signals are stored on a computer-readable medium for later reproduction.

The coding device 101 comprises an encoder 102 for encoding an audio signal according to the invention. The encoder receives the audio signal x and generates a coded signal T. The audio signal may originate from a set of microphones, e.g. via further electronic equipment such as a mixing equipment, etc. The signals may further be received as an output from another stereo player, over-the-air as a radio signal or by any other suitable means. Preferred embodiments of such an encoder according to the invention will be described below. According to one embodiment, the encoder 102 is connected to a transmitter 103 for transmitting the coded signal T via a communications channel 109 to the decoding device 105. The transmitter 103 may comprise circuitry suitable for enabling the communication of data, e.g. via a wired or a wireless data link 109. Examples of such a transmitter include a network interface, a network card, a radio transmitter, a transmitter for other suitable electromagnetic signals, such as an LED for transmitting infrared light, e.g. via an IrDa port, radio-based communications, e.g. via a Bluetooth transceiver or the like. Further examples of suitable transmitters include a cable modem, a telephone modem, an Integrated Services Digital Network (ISDN) adapter, a Digital Subscriber Line (DSL) adapter, a satellite transceiver, an Ethernet adapter or the like. Correspondingly, the communications channel 109 may be any suitable wired or wireless data link, for example of a packet-based communications network, such as the Internet or another TCP/IP network, a short-range communications link, such as an infrared link, a Bluetooth connection or another radio-based link. Further examples of the communications channels include computer networks and wireless telecommunications networks, such as a Cellular Digital Packet Data (CDPD) network, a Global System for Mobile (GSM) network, a Code Division Multiple Access (CDMA) network, a Time Division Multiple Access Network (TDMA), a General Packet Radio service (GPRS) network, a Third Generation network, such as a UMTS network, or the like. Alternatively, or additionally, the coding device may comprise one or more other interfaces 104 for communicating the coded stereo signal T to the decoding device 105.

Examples of such interfaces include a disc drive for storing data on a computer-readable medium 110, e.g. a floppy-disk drive, a read/write CD-ROM drive, a DVD-drive, etc. Other examples include a memory card slot, a magnetic card reader/writer, an interface for accessing a smart card, etc. Correspondingly, the decoding device 105 comprises a corresponding receiver 108 or receiving the signal transmitted by the transmitter and/or another interface 106 for receiving the coded stereo signal communicated via the interface 104 and the computer-readable medium 110. The decoding device further comprises a decoder 107, which receives the received signal T and decodes it an audio signal x'. Preferred embodiments of such a decoder, according to the invention, will be described below. The decoded audio signal x' may subsequently be fed into a stereo player for reproduction via a set of speakers, head-phones or the like.

The solution to the problems mentioned in the introduction is a blind method for complementing a decoded audio signal with noise. This means that, in contrast to bandwidth extension tools, no knowledge of the first coder is necessary. However, dedicated solutions are possible where the two encoders and decoders have (partial) knowledge of their specific operation.

FIG. 2 illustrates the principle of the present invention. The method comprises a first encoder generating a bit stream b1 by encoding an audio signal x to be decoded by the first decoder 203. Between the first encoder and first decoder an adaptation 205 is performed generating the bit stream b1', which e.g. could be layers being removed before transmission over network, and neither the first encoder nor the first decoder have knowledge about how the adaptation is performed. In the first decoder 203 the adapted bit stream b1' is decoded resulting in the signal x1'. According to the present invention a second encoder 207 analyses the entire input signal x to obtain a description of the temporal and spectral envelopes of the audio signal x. Alternatively, the second encoder may generate information to capture psycho-acoustically relevant data, e.g., the masking curve induced by the input signal. This results in a bit stream b2 being the input to the second decoder 209. From this secondary data b2 a noise signal can be generated, which mimics the input signal in temporal and spectral envelope only or gives rise to the same masking curve as the original input, but misses the waveform match to the original signal completely. From comparison of the first decoded signal x1' and (the characteristics of) the noise signal, the parts of the first signal, which need to be complemented, are determined in the second decoder 209 resulting in the noise signal x2'. Finally, by adding the x1' and x2' using an adder 211 the decoded signal x' is generated.

The second encoder 207 encodes a description of the spectro-temporal envelope of the input signal x or of the masking curve. A typical way of deriving the spectro-temporal envelope is by using linear prediction (producing prediction coefficients, where the linear prediction can be associated with either FIR or IIR filters) and analyzing the residual produced by the linear prediction for its (local) energy level or temporal envelope, e.g., by temporal noise shaping (TNS). In that case, the bit stream b2 contains filter coefficients for the spectral envelope and parameters for the temporal amplitude or energy envelope.

In FIG. 3 the principle of the second decoder for generating the additional noise signal is illustrated. The second decoder 301 receives the spectro-temporal information in b2, and on the basis of this information a generator 303 can generate a noise signal r2' having the same spectro-temporal envelope as the input signal x. This signal r2', however, misses the waveform match to the original signal x. Since a part of the signal x is already contained in bit stream b1 and, therefore, in x1', a control box 305 having input b2' and x1', determines which spectro-temporal parts are already covered in x1'. From that knowledge, a time-varying filter 307 can be designed, which, when applied to the noise signal r2', creates a noise signal x2' covering those spectro-temporal parts which are insufficiently contained in x1'. For reasons of reduced complexity, information from the generator 303 may be accessible to the control box 305.

In the case that the spectro-temporal information b2 is contained in filter coefficients describing the spectral and temporal envelopes separately, the processing in the generator 303 typically consists of creating a realization of a stochastic signal, adjusting its amplitude (or energy) according to the transmitted temporal envelope and filtering by a synthesis filter. In FIG. 4 it is in more detail illustrated, which elements could be comprised in the generator 303 and the time-varying filter 307. The signal creation x2' consists of generating a (white) noise sequence using a noise generator 401 and three processing steps 403, 405 and 407:

- temporal envelope adaptation by the temporal shaper 403 according to data in $b_2$ resulting in $r_2$,
- spectral envelope adaptation by the spectral shaper 405 according to data in $b_2$ resulting in r2',
- and a filtering operation by the adaptive filter 407 using time-varying coefficients c2 from the control box 305 in FIG. 3.

It is noted that the order of these three processing steps is rather arbitrary. The adaptive filter 407 can be realized by a transversal filter (tapped-delay-line), an ARMA filter, by filtering in the frequency domain, or by psycho-acoustically inspired filters such as the filter appearing in warped linear prediction or Laguerre and Kautz based linear prediction.

There are numerous ways to define the adaptive filter 407 and to estimate its parameters c2 by the control box.

FIG. 5 illustrates a first embodiment of the processing performed in the control box and the adaptive filter by using direct comparison. The (local) spectra X1' and R2' of x1' and r2' can be created by taking the absolute value of the (windowed) Fourier transforms in respectively 501 and 503. In the comparer 505 the spectras x1' and r2' are compared defining a target filter spectrum based on the difference of the characteristics of x1' and r2'. For instance, a value of 0 may be assigned to those frequencies where the spectrum of x1' exceeds that of r2' and a value of 1 may be set otherwise. This then specifies a desired frequency response, and several standard procedures can be used to construct a filter, which approximates this frequency behaviour. The construction of the filter performed in the filter design box 507 produces filter coefficients c2. In the notch filter 509 based on the filter coefficients c2 the noise signal r2' is filtered, whereby the noise signal x2' only comprises those spectro-temporal parts, which are insufficiently contained in x1'. Finally, the decoded signal x' is generated by adding x1' and x2'. As an alternative to the above, R2' can be derived directly from parameter stream b2.

FIG. 6 illustrates a second embodiment of the processing performed in the control box and the adaptive filter by using residual comparison. In this embodiment it is assumed that the bit stream b2 contains the coefficients of a prediction filter that was applied to the input audio x in encoder Enc2. Then the signal x1' can be filtered by an analysis filter associated with these prediction coefficients creating a residual signal r1. Thus, x1' is first spectrally flattened in 601 based on the spectral data of b2 resulting in the signal r1. Then the local Fourier transform R1 is determined in 603 from r1. The spectrum of R1 is compared with that of R2, i.e., the spectrum of r2. Since r2 is created by applying an envelope on basis of the data b2 on top of a white noise signal produced by NG, the spectrum of R2 can be directly determined from the parameters in b2. The comparison carried out in 605 defines a target filter spectrum, which is input to a filter design box 607 producing filter coefficients c2.

An alternative to the comparison of the spectra is using linear prediction. Assume that the bit stream b2 contains the coefficients of a prediction filter that was applied in the second encoder. Then the signal x1' can be filtered by the analysis filter associated with these prediction filters creating a residual signal r1. The adaptive filter AF could be defined as:

$$F(z) = c_0\left[1 - \sum_{l=1}^{L} c_l F_l(z)\right]$$

with arbitrary stable causal filters $F_1(z)$. The task of the control box is then to estimate the coefficients $c_{l,i}=0, 1, \ldots, L$.

The sum of r1 and r2 filtered by F(z) should have a flat spectrum. In an iterative way, the coefficients can now be determined. The procedure is as follows:

- A signal sk being r1 plus a r2, k is constructed where it is started with r2,1=r2 in the first iteration k=1.
- By linear prediction, the spectrum of the signal sk is flattened. The linear prediction defines a filter $F^{(k)}$. This filter is applied to r2,k creating r2,k+1. This signal is used in the next iteration.
- The iteration stops when $F^{(k)}$ is sufficiently close to the trivial filter, i.e., when the signal Sk can not be flattened anymore and $c_1, \ldots, c_L \approx 0$.

In practice a single iteration may be sufficient. The adaptive filter consists of the cascade of filters $F^{(1)}$ to $F^{(K-1)}$ where K is the last iteration.

Although not illustrated in FIG. 2, the bit stream b2 can also be partially scalable. This is allowed in so far as the remaining specttotemporal information is sufficiently intact to guarantee a proper functioning of the second decoder.

In the above the scheme has been presented as an all-purpose additional path. It is obvious that the first and second encoder and the first and second decoder can be merged, thus obtaining dedicated coders with the advantage of a better performance (in terms of quality, bit rate and/or complexity) but at the expense of loosing generality. An example of such a situation is depicted in FIG. 7 where the bit streams b1 and b2 generated by the first encoder 701 and second encoder 703 are merged into a single bit stream using a multiplexer 705, and where the first encoder 701 uses information from the second encoder 703. Consequently, the decoder 707 uses both the information of streams b1 and b2 for construction of x1'.

In an even further coupling, the second encoder may use information of the first encoder, and the decoding of the noise is then on basis of b, i.e. there is not a clear separation anymore. In all cases, the bit stream b may then be only scaled in as far as it does not essentially affect the operation of being able to construct an adequate complementary noise signal.

In the following, specific examples will be given when the invention is used in combination with a parametric (or sinusoidal) audio coder operating in bit-rate scalable mode.

The audio signal, restricted to one frame, is denoted x[n]. The basis of this embodiment is to approximate the spectral shape of x[n] by applying linear prediction in the audio coder. The general block-diagram of these prediction schemes is illustrated in FIG. 8. The audio signal restricted to one frame, x[n], is predicted by the LPA module 801, resulting in the prediction residual r[n] and prediction coefficients $\alpha 1, \ldots \alpha K$, where the prediction order is K.

The prediction residual r[n] is a spectrally flattened version of x[n] when the prediction coefficients $\alpha 1, \ldots \alpha K$ are determined by minimizing:

$$\Sigma_n |r[n]|^2$$

or a weighted version of r[n].

The transfer function of the linear-prediction analysis module, LPA, can be denoted by $F_A(z)=F_A(\alpha 1, \ldots \alpha K; z)$, and the transfer function of the synthesis module, LPS, can be denoted by Fs(z), where $$Fs(z) = \frac{1}{F_A(z)}$$

The impulse responses of the LPA and LPS modules can be denoted by $f_A[n]$ and $f_s[n]$, respectively. The temporal envelope Er[n] of the residual signal r[n] is measured on a frame-by-frame basis in the encoder and its parameters pE are placed in the bit stream.

The decoder produces a noise component, complementing the sinusoidal component by utilizing the sinusoidal frequency parameters. The temporal envelope Er[n], which can be reconstructed from the data pE contained in the bit-stream, is applied to a spectrally flat stochastic signal to obtain $r_{random}[n]$, where $r_{random}[n]$ has the same temporal envelope as r[n]. $r_{random}$ will also be referred to as rr in the following.

The sinusoidal frequencies associated with this frame are denoted by $\theta 1, \ldots, \theta Nc$. Usually, these frequencies are assumed constant in parametric audio coders, however, since they are linked to form tracks, they may vary, linearly, for example, to ensure smoother frequency transitions at frame boundaries.

The random signal is then attenuated at these frequencies by convolving it with the impulse response of the following band-rejection filter:

$$rn[n]=rr[n]*f_n[n]$$

where $f_n[n]=f_n(\theta 1, \ldots, \theta Nc;n)$ and * denote convolution. The spectral shape of the original frame x[n] with the exception of the frequency regions around the encoded sinusoids is approximated by applying the LPS module (803 in FIG. 8) to rn[n], resulting in the noise component for the frame:

$$xn[n]=rn[n] * f_s[n]$$

Therefore, the noise component is adapted according to the sinusoidal component to obtain the desired spectral shape.

The decoded version x'[n] of the frame x[n] is the sum of the sinusoidal and noise components.

$$x'[n]=xs[n]+xn[n]$$

It is to be noticed that the sinusoidal component xs[n] is decoded from the sinusoidal parameters, contained in the bit-stream, in the usual way:

$$xs[n] = \sum_{m=1}^{Nc} am\cos(\phi m + \theta m[n]n)$$

where am and $\phi m$ are the amplitude and phase of sinusoid m, respectively; and the bitstream contains Nc sinusoids.

The prediction coefficients $\alpha 1, \ldots \alpha K$ and the average power P derived from the temporal envelope provide an estimate of the sinusoidal amplitude parameters:

$$\hat{a}_m=2\sqrt{P}|F_S(e^{j\theta_m})|$$

The prediction errors $\delta_m[n]=a_m[n]-\hat{a}_m[n]$ are expected to be small, and encoding them is cheap. As a result, the amplitude parameters are not inter-frame differentially encoded anymore, as is standard practice in parametric audio coders. Instead, the $\delta_m[n]$'s are encoded. This is an advantage over the current encoding of amplitude parameters, since the $\delta_m[n]$'s are not sensitive to frame erasures. Frequency parameters are still inter-frame differentially encoded. When no amplitude parameters are contained in the layered bit-stream, the sinusoidal component is estimated in the decoder by:

$$\hat{x}s[n] = \sum_{m=1}^{Nc} \hat{a}_m[n]\cos(\phi_m + \theta_m[n]n)$$

In the following concrete examples using the above theory will be described. The analysis process, performed in the encoder, uses overlapping amplitude complimentary windows to obtain prediction coefficients and sinusoidal parameters. The window applied to a frame is denoted w[n]. A suitable window is the Hann window:

$$w[n] = \begin{cases} \frac{1}{2} - \frac{1}{2}\cos\left(2\pi\frac{n-1}{Ns-1}\right) & \text{if } n = 1, \ldots, Ns \\ 0 & \text{else} \end{cases}$$

with a duration of Ns samples corresponding to 10-60 ms. The input signal is fed through the analysis filter whose coefficients are regularly updated based on the measure prediction coefficients, thus creating the residual signal r[n]. The temporal envelope Er[n] is measured and its parameters pE are placed in the bit stream. Furthermore, the prediction coefficients and sinusoidal parameters are placed in the bit-stream and transmitted to the decoder also.

In the decoder, a spectrally flat random signal $r_{stochastic}[n]$is generated from a free running noise generator. The amplitude of the random signal for the frame is adjusted such that its envelope corresponds to the data pE in the bit stream resulting in the signal $r_{frame}[n]$.

The signal $r_{frame}[n]$ is windowed and the Fourier transform of this windowed signal is denoted by Rw. From this Fourier transform, the regions around the transmitted sinusoidal components are removed by band-rejection filter.

The band-rejection filter with zeros at frequencies θ1[n], . . . , θNc[n], has the following transfer function:

$$Fn(\theta_1, \ldots, \theta_{Nc};\ e^{j\theta}) = 1 - \sum_{m=1}^{Nc} (wn(\theta - \theta m) + wn(\theta - [2\pi - \theta m]))$$

where wn(θ) is the Hann window:

$$wn(\theta) = \begin{cases} \frac{1}{2} - \frac{1}{2}\cos\left(\pi \frac{\theta}{\theta_{BW}}\right) & \text{if } |\theta \le \theta_{BW}| \\ 0 & \text{else} \end{cases}$$

with (effective) bandwidth $\theta_{BW}$ equal to the width of the (spectral) main lobe of the time window w[n]. The noise component for the frame is obtained by applying the band-rejection filter and LPS module: xn=IDFT(Rw·Fn·Fs), where Fn and Fs are appropriately sampled versions of Fs and Fn and where IDFT is the inverse DFT. Consecutive sequences xn can be overlap-added to form the complete noise signal.

In FIG. 9 an embodiment of an encoder according to the present invention is illustrated. First a linear prediction analysis is performed on the audio signal using a linear prediction analyzer 901 which results in the prediction coefficients α1, . . . αK K and the residual r[n]. Next the temporal envelope Er[n]of the residual, is determined in 903 and the output comprises the parameters pE. Both r[n] and the original audio signal x[n], together with pE, are input to the residual coder 905. The residual coder is a modified sinusoidal coder. The sinusoids contained in the residual r[n] are coded while making use of x[n], resulting in the coded residual Cr. (Perceptual information, in the form of spectral and temporal masking effects and the perceptual relevance of sinusoids, is obtained from x[n].) Furthermore, pE is used to encode the sinusoidal amplitude parameters in a manner similar to the one described above. The audio signal x is then represented by α1, . . . αK, pE and cr.

The decoder for decoding the parameters α1, . . . αK, pE and cr to generate the decoded audio signal x' is illustrated in FIG. 10. In the decoder, cr is decoded in the residual decoder 1005, resulting in rs[n] being an approximation of the deterministic components (or sinusoids) contained in r[n]. The sinusoidal frequency parameters θ1, . . . , θNc, contained in cr, are also fed to the band-rejection filter 1001. A white noise module 1003 produces a spectrally flat random signal rr[n] with temporal envelope Er[n]. Filtering rr[n] by the band-rejection filter 1001, results in rn[n] which in 1008 is added to rs[n], resulting in the spectrally flat rd[n], being an approximation of the residual r[n] in the encoder. The spectral envelope of the original audio signal is approximated by applying the linear prediction synthesis filter 1007 to rd[n], given the prediction coefficients α1, . . . αK. The resulting signal x'[n] is the decoded version of x[n].

In FIG. 11 another embodiment of an encoder according to the present invention is illustrated. The audio signal x[n] itself is coded by a sinusoidal coder 1101; this in contrast to embodiment in FIG. 9. The linear prediction analysis 1103 is applied to the audio signal x[n] resulting in the prediction coefficients α1, . . . αK and residual r[n]. The temporal envelope of the residual, Er[n], is determined in 1105 and its parameters are contained in pE. The sinusoids contained in x[n] are coded by the sinusoidal coder 1101, where pE and the prediction coefficients α1, . . . αK are used to encode the amplitude parameters as discussed earlier and the result is the coded signal cx. The audio signal x is then represented by α1, . . . αK, pE and cx.

The decoder for decoding the parameters α1, . . . αK, pE and cx to generate the decoded audio signal x' is illustrated in FIG. 12. In the decoder scheme cx is decoded by the sinusoidal decoder 1201 while making use of pE and the prediction coefficients α1, . . . αK, resulting in xs[n]. The white noise module 1203 produces a spectrally flat random signal rr[n] with a temporal envelope of Er[n]. The sinusoidal frequency parameters θ1, . . . , θNc contained in cx, are fed to a band-rejection filter 1205. Applying the band-rejection filter 1205 to rr[n] results in rn[n]. Then applying the LPS module 1207 to rn[n], given the prediction coefficients α1, . . . αK, results in the noise component xn[n]. Adding xn[n] and xs[n] results in x'[n] being the decoded version of x[n].

It is noted that the above may be implemented as general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

It should be noted that the above-mentioned embodiments illustrate rather than limit the invention and that those skilled in the art will be able to design many alternative embodiments without departing from the scope of the appended claims. In the claims any reference signs placed between parentheses shall not be construed as limiting the claim. The word 'comprising' does not exclude the presence of other elements or steps than those listed in a claim. The invention can be implemented by means of hardware comprising several distinct elements and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of encoding an audio signal, said method comprising the step of generating a code signal from the audio signal according to a predefined coding method, wherein the method further comprises the steps of:

transforming the audio signal into a set of transformation parameters defining at least a part of the spectro-temporal information in said audio signal, said transformation parameters enabling generation of a noise signal having spectro-temporal characteristics substantially similar to said audio signal; and representing said audio signal by said code signal and said transformation parameters.

2. The method as claimed in claim 1, wherein the transformation parameters include at least one prediction coefficient and/or energy level and/or amplitude level and/or gain and/or power level of the audio signal.

3. The method according to claim 1, wherein the transformation parameters (b2) comprise psycho-acoustic data such as a masking curve and/or an excitation pattern and/or a loudness of the audio signal.

4. The method as claimed in claim 1, wherein the code signal comprises amplitude and frequency parameters defining at least one sinusoidal component of said audio signal.

5. The method as claimed in claim 1, wherein the transformation parameters are representative of an estimate of an amplitude of sinusoidal components of said audio signal.

6. A method of decoding an audio signal from transformation parameters and a code signal generated according to a predefined coding method ,the method comprising the steps of:

decoding said code signal into a first audio signal using a decoding method corresponding to said predefined coding method;

generating, from said transformation parameters, a noise signal having spectro-temporal characteristics substantially similar to said audio signal;

generating a second audio signal by removing from the noise signal spectro-temporal parts of the audio signal that are already contained in the first audio signal; and generating the audio signal by adding the first audio signal and the second audio signal.

7. The method as claimed in claim 6, wherein said step of generating the second audio signal comprises:

deriving a frequency response by comparing a spectrum of the first audio signal with a spectrum of the noise signal; and filtering the noise signal in accordance with said frequency response.

8. The method as claimed in claim 6, wherein said step of generating the second audio signal comprises:

generating a first residual signal by spectrally flattening the first audio signal in dependence on spectral data in the transformation parameters;

generating a second residual signal by temporally shaping a noise sequence in dependence on temporal data in the transformation parameters;

deriving a frequency response by comparing a spectrum of the first residual signal with a spectrum of the second residual signal; and filtering the noise signal in accordance with said frequency response.

9. The method as claimed in claim 6, wherein said step of generating the second audio signal comprises:

generating a first residual signal by spectrally flattening the first audio signal in dependence on spectral data in the transformation parameters;

generating a second residual signal by temporally shaping a noise sequence in dependence on temporal data in the transformation parameters;

adding the first residual signal and the second residual signal (r2) into a sum signal;

deriving a frequency response for spectrally flattening the sum signal;

updating the second residual signal by filtering the second residual signal in accordance with said frequency response;

repeating said steps of adding, deriving and updating until a spectrum of the sum signal; is substantially flat; and filtering the noise signal in accordance with all of the derived frequency responses.

10. A device for encoding an audio signal, the device comprising a first encoder for generating a code signal (b1) according to a predefined coding method, wherein the device further comprises:

a second encoder for transforming the audio signal (x) into a set of transformation parameters defining at least a part of the spectro-temporal information in said audio signal (x), said transformation parameters enabling generation of a noise signal having spectro-temporal characteristics substantially similar to said audio signal; and processing means for representing said audio signal by said code signal and said transformation parameters.

11. A device for decoding an audio signal from transformation parameters and a code signal generated according to a predefined coding method, the device comprising:

a first decoder for decoding said code signal into a first audio signal using a decoding method corresponding to said predefined coding method;

a second decoder for generating, from said transformation parameters, a noise signal having spectro-temporal characteristics substantially similar to said audio signal;

first processing means for generating a second audio signal by removing from the noise signal spectro-temporal parts of the audio signal that are already contained in the first audio signal; and adding means for generating the audio signal by adding the first audio signal and the second audio signal.

12. A computer-readable medium comprising a data record indicative of an encoded audio signal according to claim 11.

* * * * *